United States Patent [19]

Calabretta

[11] 4,071,306

[45] Jan. 31, 1978

[54] ROTARY VANE COMPRESSOR WITH RELIEF MEANS FOR VANE SLOTS

[75] Inventor: Peter Trent Calabretta, York, Pa.

[73] Assignee: Borg-Warner Corporation, Chicago, Ill.

[21] Appl. No.: 656,480

[22] Filed: Feb. 9, 1976

Related U.S. Application Data

[63] Continuation-in-part of Ser. No. 568,747, April 16, 1975, abandoned, and a continuation-in-part of Ser. No. 568,748, April 16, 1975, abandoned, and a continuation-in-part of Ser. No. 568,749, April 16, 1975, abandoned.

[51] Int. Cl.[2] ..... F04C 29/02

[52] U.S. Cl. ..... 418/82; 418/87; 418/93

[58] Field of Search ..... 418/82, 87, 93, 96, 418/97, 99

[56] References Cited

U.S. PATENT DOCUMENTS

| | | | |
|---|---|---|---|
| 226,773 | 4/1880 | Newcomb | 418/82 |
| 1,854,692 | 4/1932 | Cooper | 418/82 |
| 2,400,286 | 5/1946 | Buckbee | 418/93 |
| 2,522,824 | 9/1950 | Hicks | 418/99 |
| 2,634,904 | 4/1953 | Clerc | 418/96 |
| 2,653,551 | 9/1953 | Rosaen | 418/74 |
| 2,846,138 | 8/1958 | Racklyeft | 418/93 |
| 2,929,550 | 3/1960 | Sadler | 418/96 X |
| 2,988,267 | 6/1961 | Kosfeld | 417/410 |
| 3,243,103 | 3/1966 | Bellmer | 418/87 |
| 3,649,140 | 3/1972 | Harlin | 418/87 |

FOREIGN PATENT DOCUMENTS

| | | | |
|---|---|---|---|
| 516,611 | 1/1953 | Belgium | 418/93 |
| 692,257 | 6/1953 | United Kingdom | 418/82 |

*Primary Examiner*—Carlton R. Croyle
*Assistant Examiner*—Leonard Smith
*Attorney, Agent, or Firm*—Thomas B. Hunter

[57] ABSTRACT

A rotary, sliding vane compressor is provided with means for supplying a relatively small, predetermined quantity of an incompressible fluid, such as lubricating oil, underneath the vanes. The fluid is injected at a point while the vanes are collapsing within the vane pockets formed within the rotor and is trapped underneath the vane during its movement to the contact point thereby resisting the collapse of the vane so as to hold the vane tip in continuous engagement with the stator surface in the compression cavity. The means for supplying the fluid underneath said vanes includes a device for interrupting flow of lubricant from a sump to the interior of the compressor housing thereby controlling or metering the lubricant and also preventing reverse rotation of the compressor rotor caused by oil pressure under the vanes forcing the vane tips to follow the curvature of the cylinder wall in a backward direction. Means are also provided for relieving the suction created when the vanes move outwardly in their vane slots during startup and for draining any liquid trapped under the vanes. A relief groove is milled into the face of one of the end plates and affords communication between the vane slot and a zone of higher pressure fluid.

2 Claims, 8 Drawing Figures

FIG.1
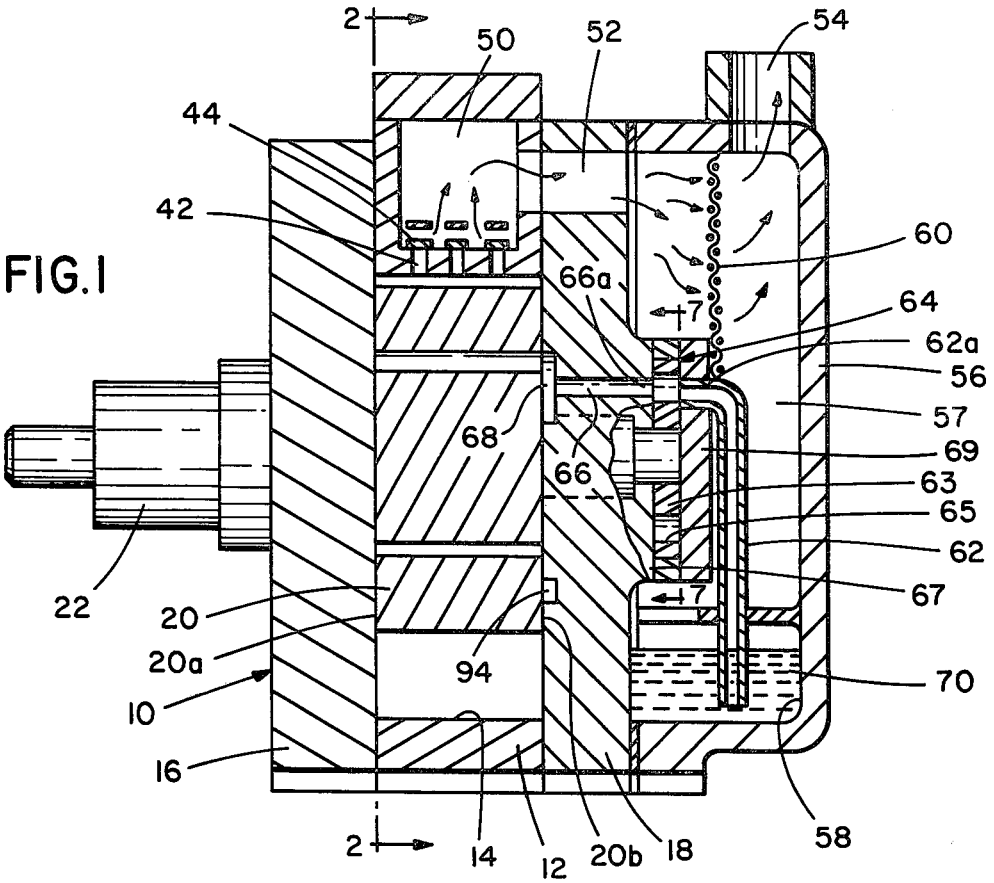
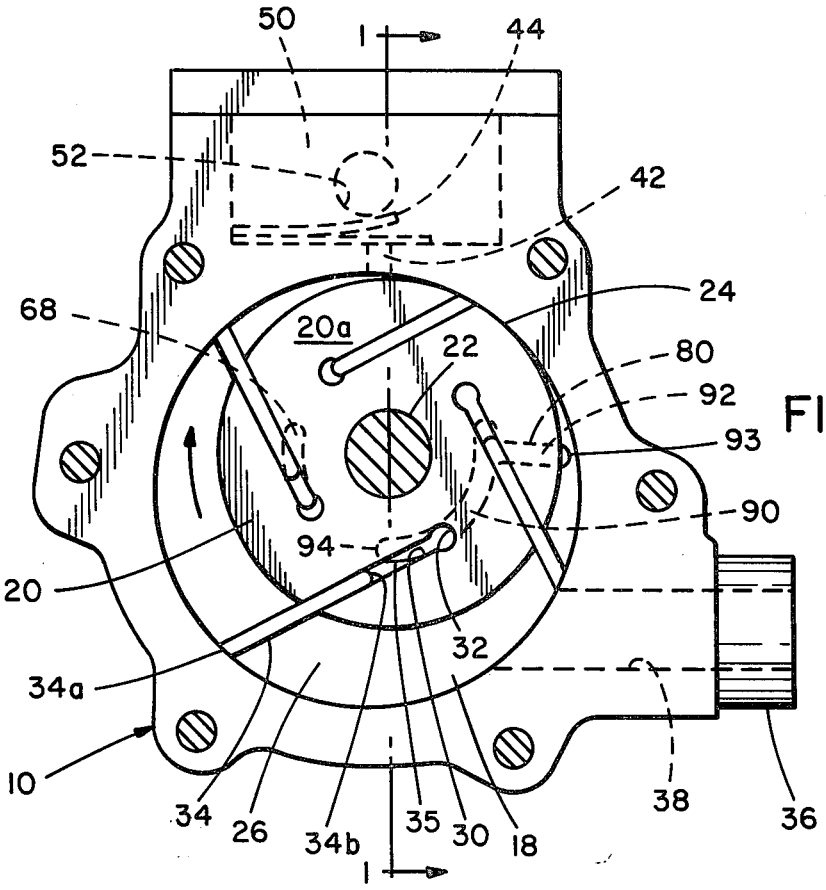
FIG.2

ROTARY VANE COMPRESSOR WITH RELIEF MEANS FOR VANE SLOTS

CROSS REFERENCE TO RELATED APPLICATIONS

This application is a continuation-in-part of my copending applications: U.S. Ser. No. 568,747 entitled Rotary Vane Compressor with Means for Relieving Undervane Space Vacuum and Trapped Liquid, P. T. Calabretta, filed Apr. 16, 1975, and now abandoned; U.S. Ser. No. 568,748 entitled Rotary Compressor with Lubricant Feed System, P. T. Calabretta, filed Apr. 16, 1975, and now abandoned; and U.S. Ser. No. 568,749 entitled Rotary Compressor, P. T. Calabretta, filed Apr. 16, 1975, and now abandoned.

BACKGROUND OF THE INVENTION

1. Field of the Invention

This invention relates to rotary sliding vane compressors and more particularly to means for holding the vanes in proper engagement with the stator surface or cylinder wall so as to secure a gas seal between the vane tips and the cylinder surface and to prevent hopping or vibration which causes wear on the vanes and the cylinder wall. Such means include a system for supplying lubricant under pressure to the vane slots and means for positively interrupting the flow of lubricant to the compressor to meter the amount of oil available for delivery to the vane slots and also prevent reverse rotation of the rotor when the compressor is shut down. Another feature includes means for breaking the suction underneath the vanes which normally occurs at startup when the vanes begin to extend outwardly in the vane slots and for relieving liquid trapped under the vanes.

2. Description of the Prior Art

A wide variety of techniques have been used in the prior art to obtain continuous contact between the vane tips and the cylinder wall. One of the most common is the use of springs or other resilient elements which bias the vanes outwardly for this purpose. An example of this type of arrangement is found in U.S. Pat. No. 2,816,702 issued to R. R. Woodcock on Dec. 17, 1957. One of the deficiencies is the tendency of the small springs required to break under the rapid expansion and contraction of the vane within the vane slot. Still another technique, which is more closely related to the subject matter of the present invention, is to utilize oil at or near discharge pressure to maintain an outward thrust on the vane. This has the disadvantage of high vane loading at all times, creating wear when the vanes are passing through the suction area. An example of this arrangement is found in U.S. Pat. No. 2,846,138 issued to C. E. Racklyeft on Aug. 5, 1958.

Still another arrangement which may have possible utility in air compressors, as distinguished from refrigeration compressors is described in U.S. Pat. No. 3,434,655 issued to F. O. Bellmer on Mar. 25, 1969. In Bellmer, gas is trapped underneath the vane to form an elastic pocket or "gas spring" during the collapse of the vane inward during the compression phase of the cycle. At or near the contact point, the pressure is relieved until such point as the vane again begins its inward or collapsing movement approaching the contact point.

Belgian Pat. No. 516,611 also shows a gas compressor with a passage communicating with an undervane space; but said spaces are not filled with liquid.

U.S. Pat. No. 2,400,286 (Buckbee) describes a compressor which is similar to Belgian Pat. No. 516,611 in that air is admitted to and trapped in the undervane spaces while U.S. Pat. No. 2,522,824 (Hicks) employs oil to bias the vanes against the cylinder wall. The latter, however, has no means for controlling the flow of oil available to the undervane spaces.

U.S. Pat. Nos. 2,653,551 (Rosaen) and 3,782,867 (Gerlach et al.) generally disclose trapping of fluid under the vanes in a rotary vane compressor.

U.S. Pat. No. 3,649,140 issued to L. E. Harlin on Mar. 14, 1972 describes a rotary metering valve mechanism which is connected to the rotor such that lubricant flowing from the sump to the compressor is caused to enter into a chamber provided by a bore in the metering valve. When the valve is rotated a predetermined distance it registers with an outlet where the lubricant is then caused to flow to the compressor cavity. In this manner, the flow of oil is prevented during occasional reverse rotation of the compressor rotor caused by the equalization of the pressure differential between suction pressure and discharge pressure. In systems where the oil is supplied under the vanes, the tendency for reverse rotation to occur is caused by another factor. The pressure of oil forces the vane tip against the cylinder wall in the zone between closed suction and discharge. In order to relieve the pressure, the vane tip slides in a direction toward a larger diameter i.e. away from the contact point toward suction. This causes the rotor to move in a reverse direction. Since Harlin is supplying oil primarily to the compression cavity and the side faces of the rotor, there is no entrapment of liquid under the vanes and no cushioning effect.

Additional prior art showing various means for supplying lubricating oil to the compressor through ports communicating with the compression cavity are: Galin, U.S. Pat. No. 3,056,542 (passage 52); Kosfeld U.S. Pat. No. 2,988,267 (passage 37); Sadler U.S. Pat. No. 2,929,550 (passage 31); and Clerc U.S. Pat. No. 2,634,904 (passage 86). None of the above provide an interrupter element driven by the rotor drive shaft for intermittently blocking flow of oil to the undervane spaces and thereby metering or controlling the flow to the undervane spaces as the unique zone to which oil is directed.

The use of undervane spaces, and the vanes as pumping mechanisms, for supplying lubricant to various parts of a rotary sliding vane compressor is well known. In U.S. Pat. No. 3,480,204 issued to L. E. Harlin on Nov. 25, 1969 there is provided a passage which periodically registers with the undervane spaces, at a position adjacent the suction zone, to draw lubricant from the area around the bearing and seal, and thereby create a low pressure zone in such area. This causes the oil circulating inside the compressor housing to migrate to the low pressure zone and provide adequate lubrication to the bearing and seal.

British Pat. No. 692,257, published (complete) on June 3, 1953, shows a compressor in which oil is admitted under the vanes as they are moving outwardly and conducts the oil to one of the bearings (and seals) during the inward movement of the vanes. A return passage is also provided so that the oil passing back from the bearing cavity may be returned to the oil inlet to refill the undervane spaces. It is also known to use anti-slugging valves to clear oil from the compression cavity. An example of such means is found in U.S. Pat. No. 3,385,513, issued May 28, 1968.

SUMMARY OF THE INVENTION

In the present invention, a substantially imcompressible fluid, such as lubricating oil, is caused to flow into the undervane space defined by the bottom of the vane pocket, the underside of the individual vane, and the end plates on opposite sides of the rotor. The important distinction between the present invention and known prior art compressors operating on similar principles is that the quantity of fluid injected under the vane is relatively fixed. This is accomplished by trapping a volume of fluid underneath the vanes at a predetermined point upstream from the contact point. The trapped fluid is then squeezed out through the running clearances between the side faces of the rotor and the end plates as the vane contracts to its fully collapsed position adjacent the contact point. The rotor then rotates beyond the contact point with the vanes moving outwardly with substantially no fluid underneath the vanes until it reaches some predetermined point beyond that in which suction is closed but spaced from the contact point which constitutes the end of the compression zone.

The amount of fluid available for delivery to the undervane spaces is critical. If it is too little, the spaces will be "starved"; and if too much, excess lubricating oil will be delivered into the compression chamber via the clearances on the rotor faces etc. Accordingly, a metering device is provided which periodically interrupts the flow of oil and is proportional to compressor rotor speed. Thus a predetermined "shot" of oil is passed along to the undervane space in just the amount and at the time needed for optimum performance.

The metering devices also performs another important function as will be described now. In the typical refrigeration system, refrigerant vapor is delivered from an evaporator to a compressor which compresses the vapor for delivery to a condenser. Accordingly, the inlet to the compressor is at a relatively low pressure and the discharge outlet from the compressor is at a relatively high pressure.

Most rotary vane compressors employ a differential oiling or lubrication system. More particularly, the oil sump is located on the discharge side of the compressor so that the oil pressure is essentially equal to the compressor discharge pressure. The oil sump is connected by an oil passage to the interior of the compressor and empties into the compressor at some point which is lower in the pressure than the oil pressure.

In the present invention, where a predetermined quantity of oil is trapped in an undervane space as it moves from the point where suction is closed to the discharge valve. When the compressor is turned off, the pressure of the incoming oil (which remains at substantially discharge pressure until enough time has elapsed to equalize the pressure through the system) would tend to force the vane outwardly within its vane pocket against the cylinder wall. In this case, the vane tip wants to follow the path of least resistance to relieve the pressure being applied underneath and in so doing tends to follow the cylinder wall backwardly where the diameter is larger. This causes reverse rotation of the rotor which may cause the fluid to flow to the evaporator and superheat the gas in cycling clutch operations. It is also very annoying to the operator to have the compressor running (backwards) after it has been turned off.

In the present invention the oil flowing to the undervane spaces from the sump passes through a series of oil passages in the housing and in the discharge gas chamber. At one point, an interrupter of the metering device previously described is provided so that the flow of oil is periodically interrupted enroute to the rotor. When reverse rotation begins to occur, the rotor will move back, but only to the point where oil flow is interrupted and thus will cause the rotor to cease further movement because the oil pressure is discontinued at this point.

In a preferred embodiment, the interrupter is in the form of a disc having a series of spaced openings which intermittently register with the stationary terminus of the oil passage through one of the side plates and an oil feed tube leading from the sump. Thus the flow is blocked by the web portion between the openings for a period of time until an opening in the disc registers with the oil feed tube outlet and permits the oil to flow through to the inlet of an oil passage leading to the undervane spaces.

Still another aspect of the present invention is directed to rather specific problems which are present in most rotary sliding vane compressors. When the compressor is energized after standing idle for a period of time, there is a tendency for the vanes to stick to their most retracted position. When the rotor assembly is at rest, it will be apparent that the vanes will be in varying degress of extension, depending on their position relative to the point of tangency (contact) between the rotor and the cylinder wall. A vane at the contact point will be fully retracted and a vane directly opposite the contact point may be fully extended. All others will be at some intermediate length of extension. As the rotor moves past the contact point, the vanes are pushed to their most radially inward position. At startup, the rotational velocity is not sufficient to produce enough centrifugal force on the vanes to keep the tips in engagement with the cylinder wall. Moreover, a vacuum is created in the undervane space as the vanes began to move outwardly. This is analogous to withdrawing a cork from a bottle rapidly, thus creating a vacuum within the bottle which opposes the effort to move it out. This problem is compounded by the sticky condition of the lubricating oil in and around the vanes which has an additional retarding force on vane movement.

Another problem is caused by the fact that the lubricating oil is at least partially miscible with the refrigerant. During normal operation, most of the oil is removed from the discharge gas and collected in a sump. From there, it is transferred to critical moving parts for sealing and anti-friction use. The remaining portion is circulated through the system with the refrigerant.

When the compressor is shut down, a considerable amount of oil tends to migrate back to the compressor and condenser and floods the compression cavity and rotor. Some oil finds its way under the vanes, that is the space defined between the faces of the vane slot, the bottom of the vane slot, the lower edge of the vane and the two end plates. When the compressor is started up, the oil, being essentially noncompressible, offers resistance to the movement of the vanes inwardly and creates great pressure at the vane tip/cylinder wall interface. The only place for the oil to flow as the vanes collapse is through the clearances; and in the conventional compressor, the oil cannot flow fast enough to prevent the pressure from building up.

In order to overcome the foregoing problems, the present invention proposes that the undervane spaces be relieved to a high pressure zone as they pass into the initial phase of the suction cycle. In this way, the vacuum which would otherwise be created is relieved instantaneously, thus allowing the vanes to move freely outwardly against the cylinder wall. Once the rotational speed is up to normal, the centrifugal force is sufficient to overcome any tendency to stick; so that the vacuum relief does not play a significant factor in the operation of the compressor after it attains normal speed. In addition, an extension of the vacuum relief slot communicates with the undervane spaces in such a way that it cannot interconnect with the oil supply port. During the phase that the vane collapses, the undervane liquid is pumped back to the suction cavity through the vacuum relief slot.

BRIEF DESCRIPTION OF THE DRAWINGS

FIG. 1 is a cross sectional view of a rotary compressor constructed in accordance with the principles of the present invention;

FIG. 2 is a cross sectional view taken along the plane of line 2—2 of FIG. 1;

DETAILED DESCRIPTION OF THE INVENTION

Figure 3:
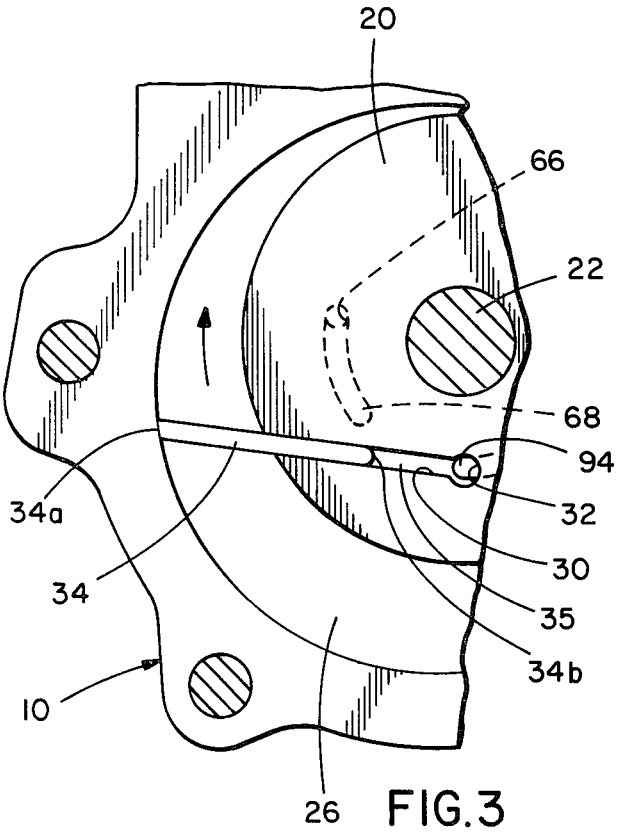
FIGS. 3-6, inclusive, are each a detailed view showing the lower portion of the vane pocket at various positions between full extension of the vane and the completely collapsed position thereof.

Referring now to the drawing, particularly to FIG. 1, there is shown a rotary compressor of generally conventional design including a stator housing 10 comprising a cylinder block 12 having a circular bore extending therethrough to provide a cylinder wall 14, a front end plate 16, and a rear end plate 18. Within housing 10 there is provided a rotor 20 connected to and driven by drive shaft 22. The rotor is eccentrically mounted within the cylinder 14 so that it is in close running contact with the cylinder wall 14 at a contact point 24 and forms a cresent-shaped gas working space or compression cavity 26. The rotor is provided with a plurality of vane slots 30 each having a bottom surface 32 and receiving vanes 34 which are adapted to reciprocate within each vane slot with their upper edges **34*a* in continuous engagement with cylinder wall 14. It may be seen that the lower sides of each slot, the bottom edge 34*b* of the vanes 34, and the bottom of the vane slot 32 define what will be referred to as the "undervane space", designated 35**.

Suction gas is admitted to the compression cavity 18 through connection 36 and passage 38. Gas is discharged through a series of openings 42 (adjacent the contact point), covered by reed-type discharge valves 44, into discharge gas plenum 50, and then flows into passage 52 in rear plate 18 and out through connection 54.

A housing 56 is secured to the rear plate 18 and provides a discharge gas chamber 57 having a lower sump portion 58 for the collection of lubricating oil which is separated from the discharge gas as it passes through separator 60 in route to the discharge gas connection 54. An oil pickup tube 62 extends downwardly into the sump and communicates with an oil feed passage 66 extending through the rear bearing plate 18 and opening up into a kidney shaped port 68 located at a point which intercepts the undervane spaces 35 as the rotor approaches the contact point 24.

As the oil flows through the oil pickup tube it passes through a rotating interrupter device 64. This device will be described in more detail below.

The port 68 is located, shaped and dimensioned so that, under a wide range of operating conditions, a predetermined quantity of lubricating oil will be fed (by the pressure of discharge gas acting on the surface of oil 70 in sump 58) into the spaces 35 underneath each vane. As the rotor travels beyond the far end of port 68, the oil will be trapped within the undervane space 34.

The boundaries of undervane spaces 35 are provided by the lower edge **34*b* of vanes 34, the bottom portion 32 of vane slots 30 and the front and rear plates 16, 18. The only escape routes for oil trapped in the undervane spaces are the clearances between the front and rear surfaces of the vanes and the vane slots and the clearances between the end surfaces 20*a*, 20*b* of rotor 20 and the front and rear plates 16, 18. These clearances, of course, are small; and they pose high resistance flow paths for the oil as it is forced out of the undervane space by the collapsing vane approaching the contact point. This resistance maintains pressure on the vane to keep the vane tip 34*a* in firm engagement with the cylinder 14**.

Figure 8:
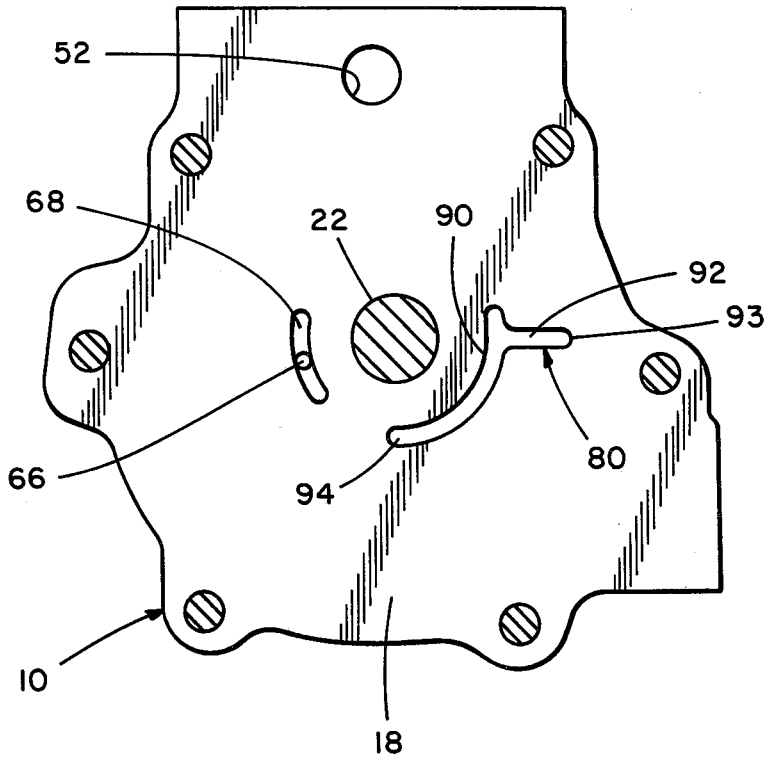
FIG. 8 is a plan view of the rear end plate.
Figure 7:
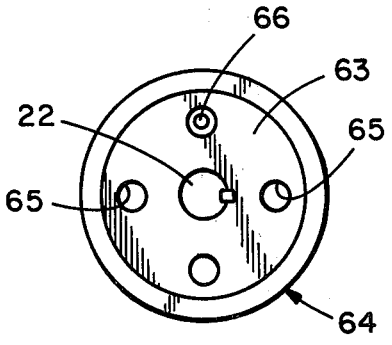
FIG. 7 is a cross sectional view taken along the plane of line 7—7 of FIG. 1 and illustrating the interrupter element in position relative to the oil flow passage.

As best shown in FIGS. 2 and 8, there is a shallow channel or slot 80 formed in the surface of rear plate 18 (or optionally in front plate 16). Slot 80 has a radially extending portion 92 to relieve vacuum in the undervane spaces to make sure that the vanes are properly extended under startup conditions. Associated with slot 80 is a passage 90 which is formed in the rear bearing plate 18 (or optionally in front plate 16). Passage 90 is milled in the form of an arcuate groove communicating with the suction side vacuum relief slot 92. The purpose of this passage is to relieve the liquid which may be present in the undervane space 35 at startup conditons and the details are more fully described below.

Figure 4:
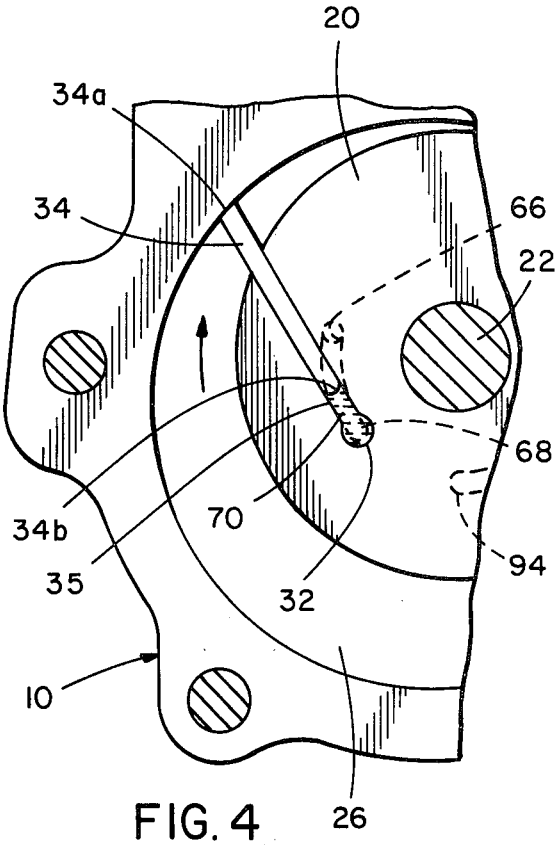
Figure 5:
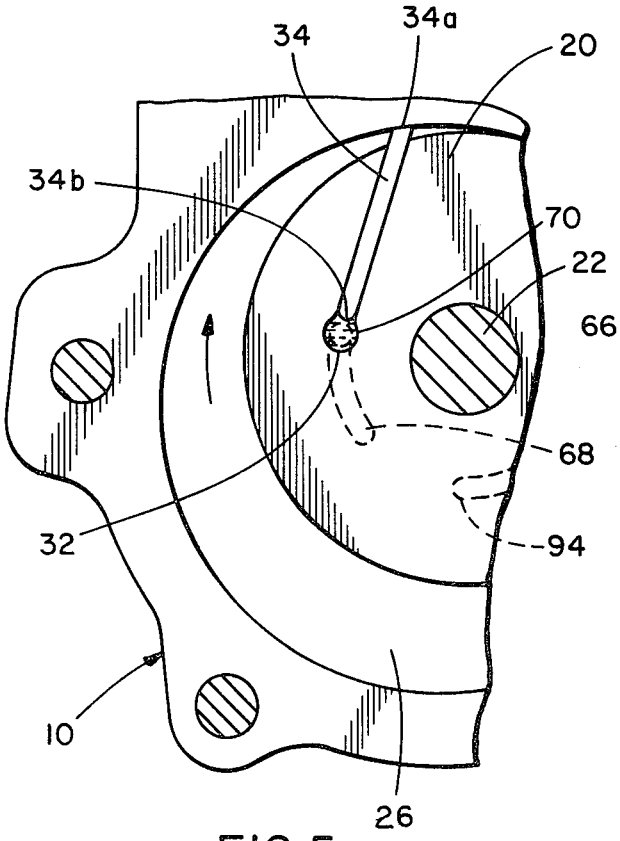
Figure 6:
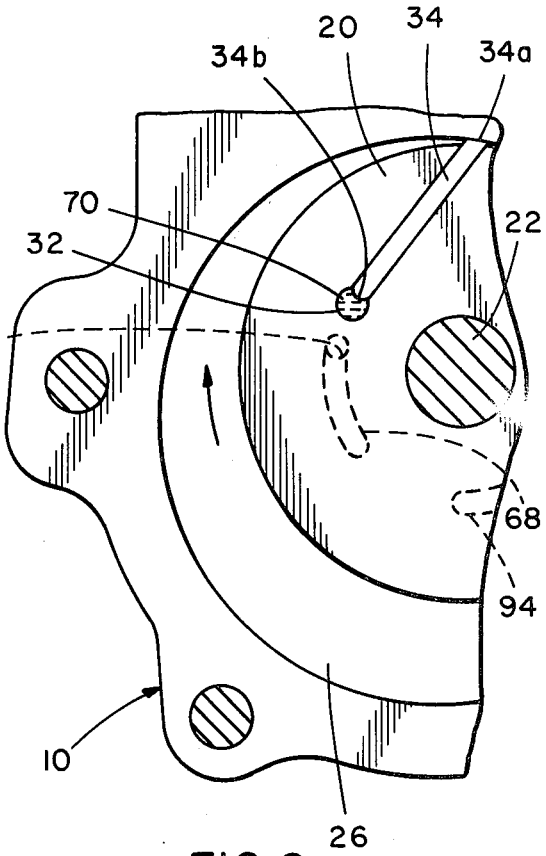

A more complete understanding of how the undervane spaces are filled, and how the oil is trapped, may be gained by reference to FIGS. 3 to 6 which show the relationship of the spaces to the port 68. In FIG. 3, the undervane space 35, moving in the direction of the arrow, is just approaching the port 68. In contrast with prior art arrangements, the spaces are substantially free of oil or other fluid at this point, because it is not necessary indeed undesirable — to force the vanes outwardly during the phase of rotation through the suction zone. In FIG. 4, the space 35 has just passed into fluid communication with port 68 thereby admitting oil to the space and filling it completely. In FIG. 5, the undervane space is approaching the far end of port 68 and is about to trap whatever oil remains in the space, it being understood that the volume of the space is contracting slightly as the space passes from one end of port 68 to the other. In FIG. 6, the vane space 35 has passed beyond the far end of port 68 so that a predetermined amount of oil is now trapped between the end of port 68 and the contact point 24, some oil will be squeezed out through the clearances between the rotor end faces **20*a* and 20*b* and plates 16, 18** and also between the faces of the vanes and the surfaces of the vane slots.

As mentioned above, the oil enroute to the cavity 68 from the sump 70 passes through an interrupter device 64 which is mounted for rotation on the rear of drive shaft 22 between the discharge gas chamber 57 and the back side of rear end plate 18. The device 64 (see FIGS.

1 and 7) comprises a disc 63 having a plurality of spaced apertures 65, each of which are substantially larger in diameter than the diameters of oil passage 66 and oil pick-up tube 62.

Disc 63 is held between a boss 67 on the rear plate 18 and a retaining plate 69 through which the end of oil pick-up tube 62 extends. During operation, the disc 63 will rotate with rotor 20 causing apertures 65 to intermittently register with the entrance end 66*a* of oil passage 66 and the discharge end 62*a* of oil pick-up tube 62. During this interval, oil will flow through the passage 66 to cavity 68. When the web portion 63*a* of disc 63 passes between 66*a* and 63*a* flow will be interrupted.

The cooperation between the interrupter and the undervane liquid feed is quite important to the successful operation of the compressor. Since the disc 63 is driven with the rotor the amount of oil available to be fed to cavity 68 is directly proportional to the requirements. Each time one of the apertures is in registration with the end of pick-up tube 62 and passage 66, a predetermined quantity of oil passes through and is made available for undervane feed. As the speed of the rotor increases, the oil flow is increased proportionally.

The other function of the interrupter may be explained as follows: When the compressor is shut down, the rotor (and disc 63) may come to rest at a position in which one of the apertures 65 permits oil flow. In such case, the pressure will be applied to the underside of vane 34*a* (at cavity 68). The force transmitted through the vane, at the tip, will cause the vane to cam backwardly along the cylinder wall 14 in an effort to seek a larger diameter position. However, as soon as it moves to a point where a web portion 63*a* of disc 63 cuts off flow, then the pressure under vane 34*a* will stabilize, and rotation will cease.

As best shown in FIGS. 1, 2 and 8, there is a shallow generally L-shaped slot 80 formed in the surface of rear plate 18. In accordance with this invention, one purpose of this slot is to relieve vacuum in the undervane space to make sure that the vanes are properly extended under startup conditions.

Slot 80 has an elongated arcuate section 90 which is spaced from the axis of rotation by a distance approximately equal to the distance between the rotational axis and the bottom of the vane slots. A second section 92 extends generally radially from one end of section 90, and, at best illustrated in FIG. 2, has its terminus 93 extending beyond the edge of the rotor into the suction zone of compression cavity 26. The other terminus of the slot, designated at 94, extends just beyond the section line 1—1 as shown in FIG. 2. This permits any liquid under the vane, which may be present at startup conditions, to flow into passages 90, and 90 and 92 to be discharged into the suction zone of cavity 26.

It will be noted that the undervane spaces 35 are in communication with arcuate section 90 for about 60° of rotation in the suction zone. Since section 90 communicates with section 92, the vacuum is immediately relieved under the vanes as they begin to extend. This allows free extension of the vanes to engage the cylinder wall during startup so the compressor will not "stall".

While this invention has been described in connection with a certain specific embodiment thereof, it is to be understood that this is by way of illustration and not by way of limitation; and the scope of the appended claims should be construed as broadly as the prior art will permit.

What is claimed is:

1. A rotary sliding vane compressor comprising: a housing providing a gas working chamber having a cylindrical wall and including end plates closing said chamber; a cylindrical rotor mounted for rotation in said chamber and having opposed end surfaces and a plurality of inwardly extending vane slots formed therein; said rotor being in sliding contact with said cylinder wall at a contact point; a gas inlet port communicating with said chamber; a gas discharge port adjacent said contact point communicating with said chamber; a gas discharge chamber associated with said housing, said gas discharge chamber having a sump portion for the accumulation of lubricating fluid separated from said gas; a plurality of vanes slidable in said vane slots each having one end thereof flush with one of the end surfaces of said rotor, a vane tip in contact with said cylindrical wall and a lower edge defining, in cooperation with the bottom of said vane slots and at least one of said end plates, an undervane space; means defining a first fluid passage in said one end plate having a fluid supply port at one end of said passage and an inlet at the opposite end, said supply port being located so that it communicates with an undervane space as the rotor moves in a direction from said gas inlet port to said gas discharge port, said fluid supply port being out of communication with said undervane space for a predetermined distance before said vane tip reaches said contact point; means for supplying a substantially incompressible fluid to said inlet whereby said fluid flows through said passage and fills said undervane spaces, trapping a predetermined quantity of fluid in said undervane spaces; said fluid being confined, except for high flow resistance leakage paths between said rotor and said housing, and between said vanes and said vane slots, as said vane approaches said contact point, said last-named means including a conduit through which said fluid is transferred from said sump portion, having an outlet aligned with, but spaced from, said fluid supply passage inlet and a disc-like element interposed between said conduit outlet and said fluid supply passage inlet and driven with said rotor, said element having a plurality of apertures therein adapted to intermittently and periodically interconnect said conduit to said fluid supply passage and means defining a second fluid passage in one of said end plates, said passage having a first portion adapted to communicate with said undervane spaces, said second fluid passage having a portion which extends into said gas working chamber so as to relieve suction created by the vanes moving outwardly during the suction phase.

2. Apparatus as defined in claim 1 wherein said second fluid passage also includes a forwardly (in the direction of vane rotation) extending section adapted to relieve any lubricating fluid accumulated under said vanes and permit it to drain to the suction side of said gas working chamber.

* * * * *